US005598651A

United States Patent [19]

Aiken et al.

[11] Patent Number: 5,598,651

[45] Date of Patent: Feb. 4, 1997

[54] SIGN MECHANISM HAVING TRAVERSABLE WEB

[75] Inventors: Robert B. Aiken, Mequon; Robert C. Clapper, Grafton, both of Wis.

[73] Assignee: Milwaukee Sign Co., Inc., Grafton, Wis.

[21] Appl. No.: 358,920

[22] Filed: Dec. 19, 1994

[51] Int. Cl.[6] ..... G09F 11/18

[52] U.S. Cl. ..... 40/518; 40/537

[58] Field of Search ..... 40/518, 536, 537, 40/159.1, 404, 5; 74/575

[56] References Cited

U.S. PATENT DOCUMENTS

| | | | |
|---|---|---|---|
| Re. 17,463 | 10/1929 | Bloomingdale | 40/5 |
| 144,648 | 11/1873 | Anyan | 40/518 |
| 274,639 | 3/1883 | Muckenhaupt | 40/5 |
| 736,564 | 8/1903 | Stollewerk | 40/518 X |
| 840,134 | 1/1907 | Klempau | 40/518 |
| 1,435,762 | 11/1922 | Tomsich | 40/159.1 |
| 1,668,704 | 5/1928 | Turrentine | 40/5 |
| 2,568,178 | 9/1951 | Widder | 40/537 X |
| 3,859,869 | 1/1975 | Pasbrig | 74/575 |
| 4,640,029 | 2/1987 | Hornblad et al. | 40/5 |
| 4,741,118 | 5/1988 | Aiken et al. | 40/518 |
| 4,916,988 | 4/1990 | Robertson et al. | 74/575 X |
| 5,412,893 | 5/1995 | Aiken, Sr. | 40/518 |

*Primary Examiner*—Joanne Silbermann

*Attorney, Agent, or Firm*—Andrus, Sceales, Starke & Sawall

[57] ABSTRACT

A side sign with a traversable web has a web roll mechanism mounted at each end of a frame member contained in signage apparatus. Each of the web roll mechanism contains a web roll rotatably mounted therein. A hand crank journaled in the web roll mechanism is connected to the web roll so that rotation of the hand crank will rotate the web roll and traverse the web across a window in the signage apparatus to display desired indicia.

30 Claims, 5 Drawing Sheets

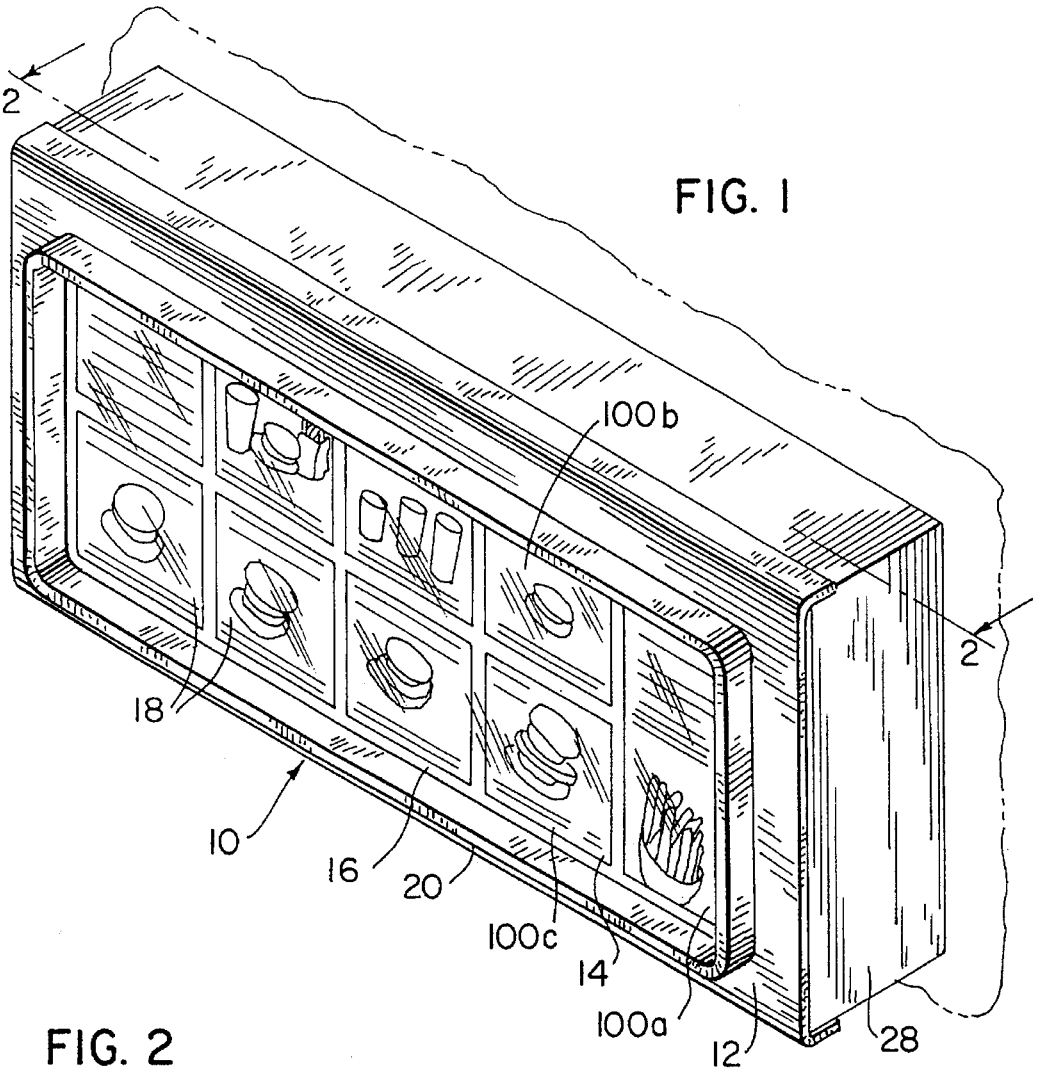
FIG. 1
FIG. 2
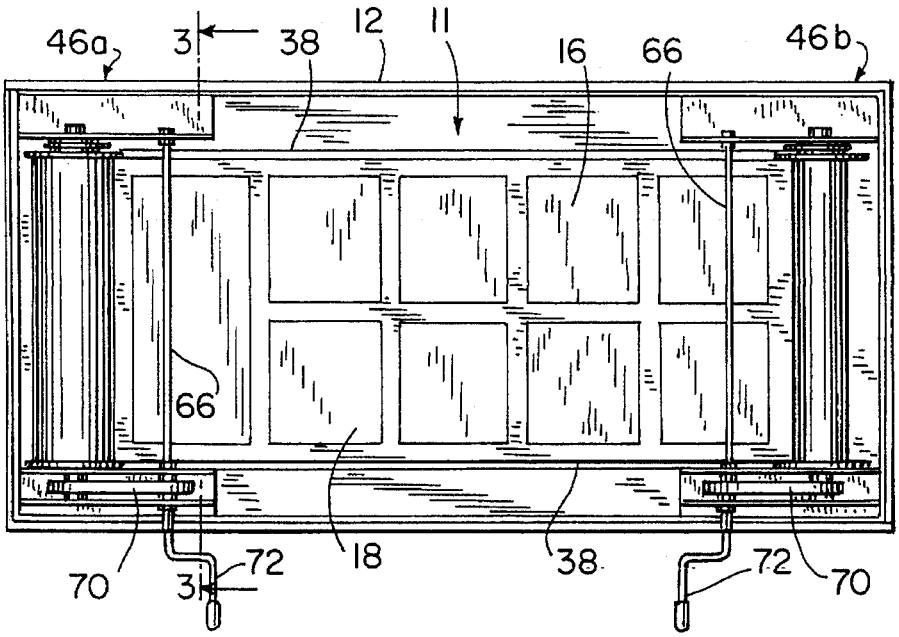

FIG. 7
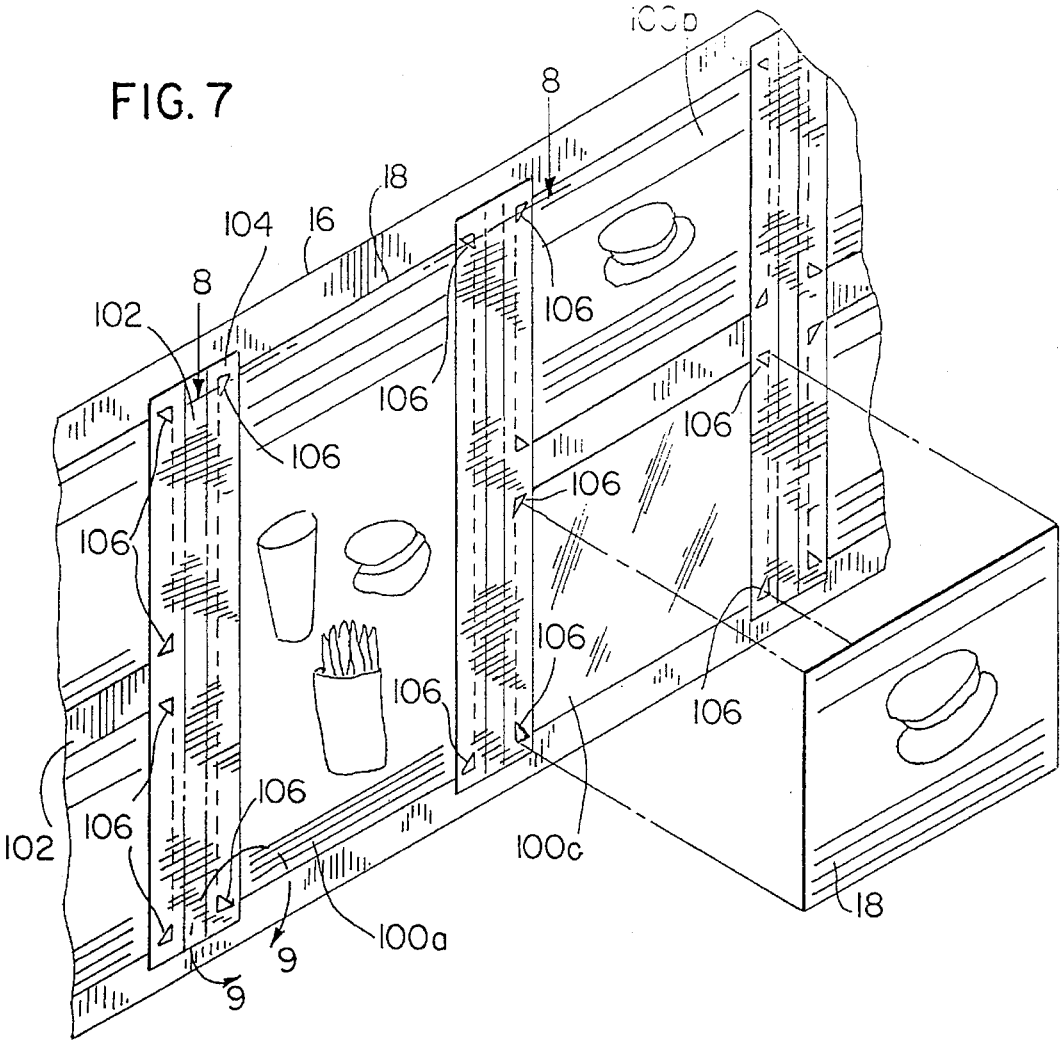
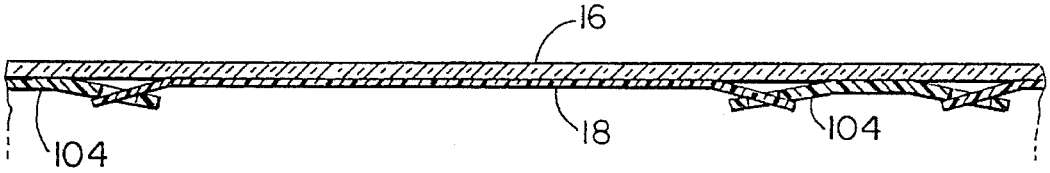
FIG. 8
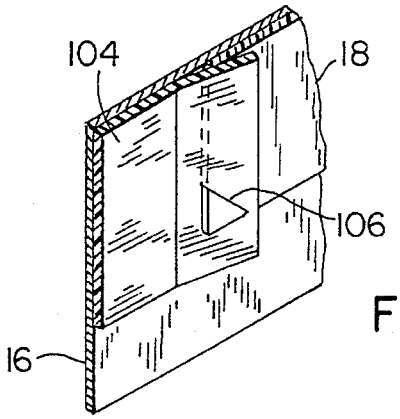
FIG. 9

SIGN MECHANISM HAVING TRAVERSABLE WEB

BACKGROUND OF THE INVENTION

The present invention relates to an improved manually operable sign mechanism having a web that is traversed through the sign mechanism to selectively display indicia panels containing information desired to be exhibited in associated signage apparatus.

SUMMARY OF THE INVENTION

In many applications, it is desired to alter the information exhibited by signage apparatus. For example, in signage employed in restaurants, it is often desired alter the exhibited information in accordance with the time of day to sequentially show breakfast items, lunch and dinner items during the course of a day. In other applications, it is desired to alter the information exhibited by signage apparatus in accordance with the season, or to inform the viewers of the signage apparatus of sale events, special promotions, and the like. In many such applications, a sign having a traversable web has advantages of achieving alteration of the information with economy and simplicity.

It is therefore the object of the present invention to provide such a sign.

It is a further object of the present invention to provide a sign that can be retrofitted into existing signage enclosures so as to easily add the web traversing, information altering feature to existing signage apparatus. It is a further object of the present invention to provide a sign mechanism in which the alterable information items to be displayed by the sign may be quickly and easily changed, when desired. Thus, for example, when the prices or selection of menu items changes, the corresponding information to be displayed by the sign mechanism can also be changed. It is yet another object of the present invention to provide a sign that is light in weight, yet durable in construction.

To these ends, the sign mechanism of the present invention comprises a frame member suitable for mounting the sign mechanism in signage apparatus. The frame member has an opening through which indicia displayed by the sign mechanism may be viewed.

A web roll mechanism is mounted at each end of the frame member, adjacent the ends of the opening. Each of the web roll mechanisms contains a web roll rotatably mounted therein. A drive means for the web roll may include a hand crank journaled in the web roll mechanism and spaced inwardly from the ends of the frame means. The hand crank is connected to the web roll by a drive means so that rotation of the hand crank will rotate the web roll.

A web extends between the web rolls and across the opening of the frame member for being wound and unwound on the web rolls to traverse the web across the opening. The web may be subdivided into a plurality of viewing subdivisions. Indicia panels contain the information desired to be exhibited by the signage apparatus. The web contains means for mounting the indicia panels on the web to position the panels in the viewing subdivisions. Such means may comprise strips fastened in spaced pairs across the web adjacent to the edges of the viewing subdivisions. The strips may be mounted to the web to form pockets in which the indicia panels are retained while at the same time relative movement between the indicia panels and the web is permitted as the web is wound on, and unwound from, the web rolls.

The strips may have slanting slits in proximity to the corners of the viewing subdivisions. The corners of the indicia panels extend through the slits to assist in retaining the indicia panels in position on the web.

In the alternative, the slanting slits may be placed in the carrier web, itself, and the indicia panels retained on the carrier web in such slits.

The indicia panels may be fastened on the rear surface of the web opposite that viewed by a viewer of a signage apparatus or on the front surface of the web.

The invention will be further understood by reference to the drawings and the following detailed description of the sign mechanism of the present invention.

BRIEF DESCRIPTION OF THE DRAWINGS

In the drawings:

FIG. 1 is a front perspective view of signage apparatus incorporating the sign mechanism of the present invention;

FIG. 2 is a rear view of the sign mechanism taken along line 2—2 of FIG. 1;

FIG. 7 is a partial perspective view of one embodiment of the traversable web incorporated in the sign mechanism of the present invention;

FIG. 8 is a cross-sectional view taken along the line 8—8 of FIG. 7;

FIG. 9 is a detailed view of the portion of the web shown in the area 9—9 of FIG. 7 and showing a manner in which indicia panels are held to the web;

DETAILED DESCRIPTION OF THE PREFERRED EMBODIMENT

Figure 3:
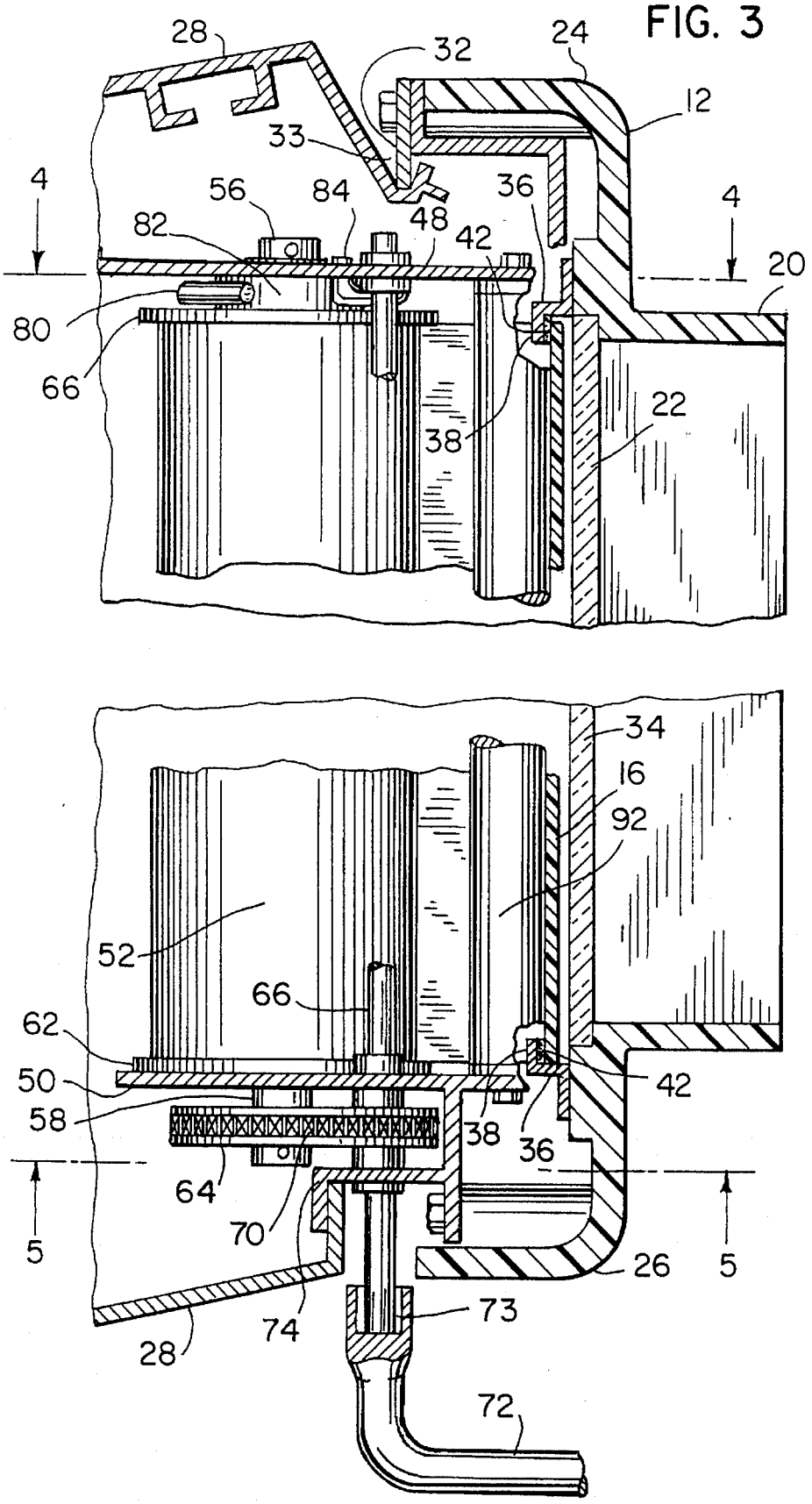
FIG. 3 is a cross-sectional view taken along line 3—3 of FIG. 2 and adjacent one end of the sign mechanism.
Figure 4:
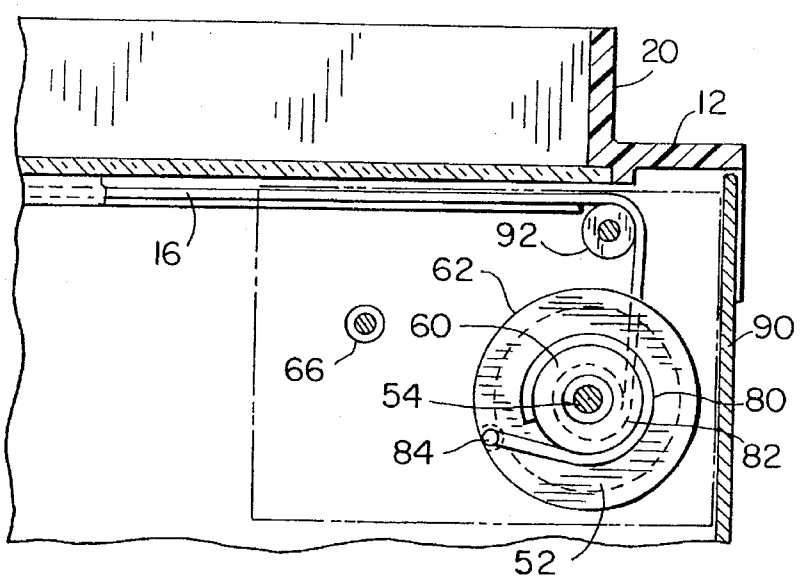
FIG. 4 is a cross-sectional view taken along the line 4—4 of FIG. 3 showing the top portion of the sign mechanism.
Figure 4:
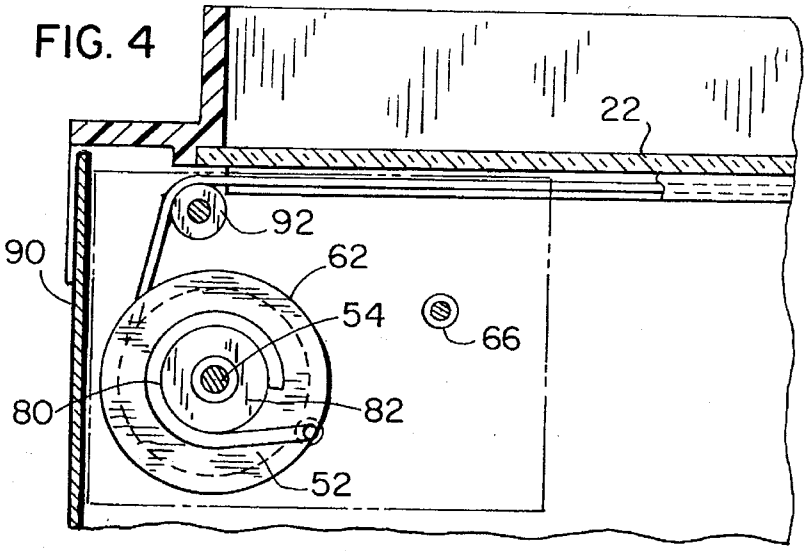

FIG. 1 shows signage apparatus 10 incorporating the sign mechanism 11 of the present invention. Sign mechanism 11 typically includes front frame member 12. Front frame member 12 may be formed of plastic, metal, or other suitable material. Front frame member 12 contains an opening 14 through which web 16, having indicia panels 18, may be viewed. Opening 14 may be surrounded by a raised lip 20 and may be covered by sheet 22 of transparent material, such as plastic or glass, as seen in FIGS. 3 and 4. The upper and lower edges 24 and 26 of front frame member 12 may be rounded and the front frame member 12 formed to fit on the front of an existing signage apparatus enclosure 28.

Sign mechanism 11 of the present invention may be mounted to the existing signage apparatus enclosure 28 by inserting flange 32 in groove 33 along the upper edge of enclosure 28. The bottom edge of the sign may be fastened to enclosure 28 by an appropriate catch, thumbscrews, spring loaded pins, or like securing means, not shown. Groove 33 is formed so that sign mechanism 11 may be pivoted with respect to the signage enclosure for servicing or the like. If additional access to sign mechanism 11 is required it may be lifted off enclosure 28 for servicing or to change one or more of indicia panels 18, as hereinafter described in detail.

As best shown in FIG. 3, a guide member 36 is mounted on the inside of front frame member 12 adjacent the upper and lower edges of opening 14. Each of guide members 36 has a rail 38 which is spaced from the inside surface 34 of sheet 22, to form a gap between the window and the rail, suitable for receiving one of the edges of web 16. The sides of rails 38 that come in contact with web 16 may be covered with a protective coating 42, tape, or the like, to lessen or avoid damage to the web and/or rail. Guide members 36 may extend along substantially the entire length of the upper and lower edges of opening 14.

While guide members 36 are shown as having rails 38 in FIG. 3, it is possible, if desired, to eliminate rail 38. The edges of web 16 are supported by the horizontal flange portions of the guide members.

A web roll mechanism **46*a* and 46*b* is mounted at each end of front frame member 12. Each of web roll mechanisms 46*a* and 46*b* are similar in construction and web roll mechanism 46*a* will be described in detail, below. Web roll mechanism 46*a* has upper and lower flange members 48, 50, one of which is mounted on the inside of front frame member 12 adjacent each of the upper and lower edges of the frame member, respectively. Web roll 52 includes shaft 54 journaled in flange members 48, 50 by suitable bearings 56 and 58. Spindle portion 60 of web roll 52, having a flange 62 at each end thereof, surrounds shaft 54 and is fastened to shaft 54** in an appropriate manner.

Figure 5:
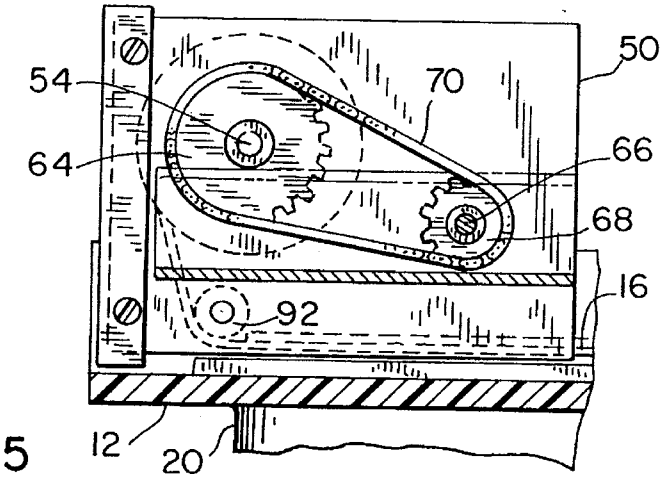
FIG. 5 is a cross-sectional view taken along the line 5—5 of FIG. 3 showing the lower portion of the sign mechanism and a drive means for the sign mechanism.
Figure 10:
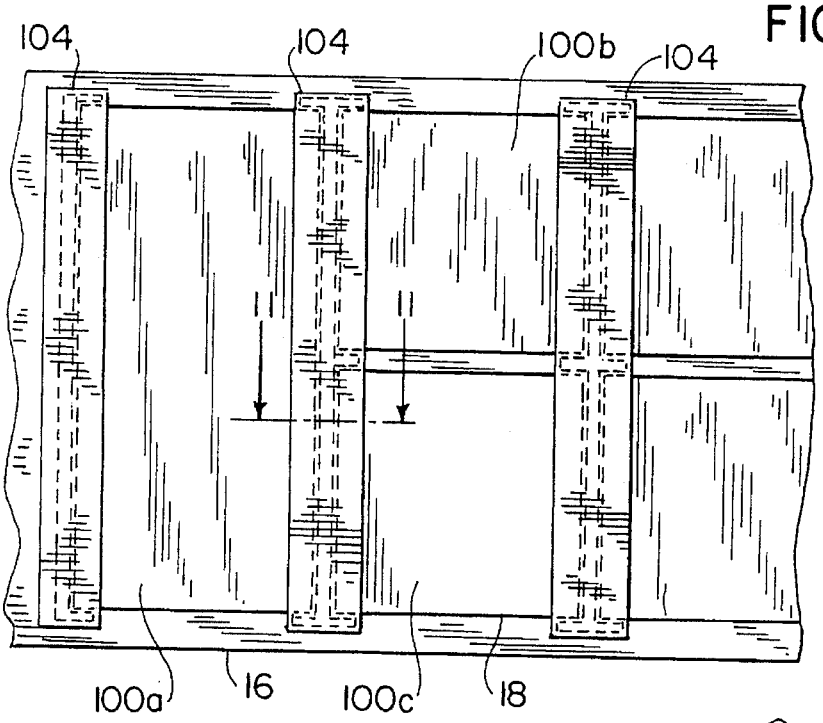
FIG. 10 is a partial view showing another embodiment of the traversable web.

At one end of web roll 52, shaft 54 extends beyond the adjacent flange member. This may preferably be at the lower end of the web roll mechanism, as shown in FIG. 3. Sprocket 64 is mounted on the exposed end of shaft 54, as shown in FIGS. 3 and 5. Shaft 66 is journaled in flange members 48, 50 to extend parallel to web roll 62 inwardly of the web roll, i.e. toward the center of sign mechanism 11. Sprocket 68 is mounted on shaft 66 adjacent sprocket 64 and is coupled to sprocket 64 by drive chain 70. The lower end of shaft 66 extends beyond the lower edge of front frame member 12, and contains hand crank 72. A further flange member 74 through which shaft 66 extends is mounted to, or formed on, flange member 50 to absorb any radial loads to which shaft 66 is subjected as a result of the operation of hand crank 72. Hand crank 72 is preferably connected to shaft 66 through a ratchet mechanism 73 in order to prevent hand crank 72 from rotating shaft 54 and the associated web roll 60 in the unwind direction.

Figure 6:
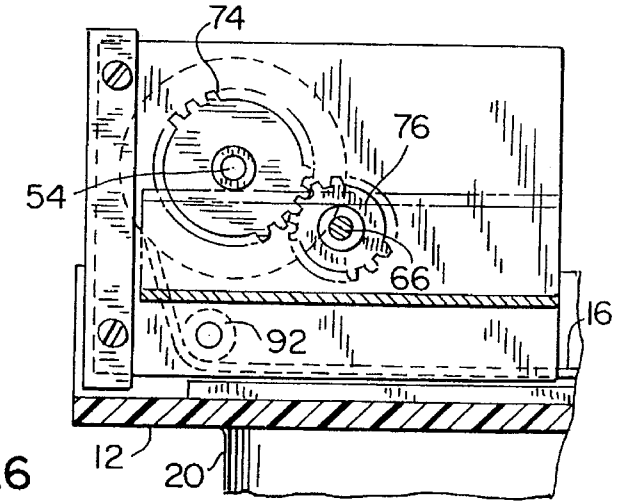
FIG. 6 is a cross-sectional view, similar to FIG. 5 showing an alternative drive means.

It will be appreciated that a belt and pulley arrangement may be used instead of the sprocket and chain shown in FIG. 5. Or as shown in FIG. 6, gears 74 and 76, mounted on shafts 54 and 66 respectively, or other appropriate gear train may be employed instead of sprockets 64 and 68 and chain 70, if desired. Or, hand crank 72 or an electric motor may be coupled to shaft 54 to rotate web roll 60.

In the embodiment of the invention shown in the Figs. of the drawing, the use of sprockets 64 and 68 and drive chain 70 positions hand crank 72 inwardly from the end of sign mechanism 11. This ensures that crank 72 may be easily operated without interference from a surrounding frame or another element positioned at either end of sign enclosure 28.

Web roll 52 may have a differential braking mechanism which may be generally of the type described in U.S. Pat. No. 4,741,118, assigned to the assignee of the present application. Such braking mechanism includes spring clip 80 that compressively engages collar 82 on the end of web roll 52, as best shown in FIG. 3. Collar 82 may contain a groove for this purpose. Spring clip 80 may comprise a piece of spring wire bent in the shape shown most clearly in FIG. 4. The shape comprises a generally partial circular configuration. An end 84 of spring clip 80 adjacent the open corner fits in a corresponding hole in an adjacent bracket, such as bracket 48 to anchor the clip, as shown in FIGS. 3 and 4. The spring clips on the web rolls 52 provide tension on web 16 at all times. However, the spring clips provide a differential braking action such that spring clip 80 provides a greater amount of braking or retarding action when the web is being unwound from a web roll than when it is being rewound onto the web roll.

In the orientation shown in FIG. 4, web roll 52 of web roll mechanism **46*a* rotates in the counterclockwise direction when the web is being unwound and in the clockwise direction when the web is being rewound. Spring clip 80 provides a greater amount of braking action in the counterclockwise direction because the collar 82 is, in effect, attempting to wrap the clip around the collar. Spring clip 80 provides a lower amount of braking action in the clockwise direction because collar 82 is rotating in a manner tending to open the spring clip. Depending on the exact configuration of spring clip 80 and collar 82**, the ratio between unwinding and rewinding braking action may be varied to suit the application.

The drag or retardation on web 16 provided by the braking mechanism maintains tension on the web when it is being moved and the aesthetics of the display seen in opening 14 while, at the same time, enabling movement of the web by hand cranks 72.

End plates 90 may be mounted on flange members 48, 50 of each of web roll mechanism **46*a*, 46*b* to protect web rolls 52 and web 16** mounted thereon.

As noted above, web roll mechanism **46*b* is similar in construction to web roll mechanism 46*a* and includes a web roll 52 driven by a hand crank 72** or other suitable means.

Web 16 may comprise a flexible film of polycarbonate plastic or other suitable transparent or translucent material. One end of web 16 is fastened to the web roll 52 of one of web roll mechanisms **46*a* or 46*b*. The other end of web 16 is fastened to the web roll 52 of the other web roll mechanism 46*a* or 46*b*. The intermediate portion of web 16 extends from one of the web rolls around an idler roll 92 mounted in the web roll mechanisms 46*a* or 46*b* and across opening 14, as shown in FIG. 4. The upper and lower edges of the web are received in the gaps between the inner surface 34 of sheet 22 of the opening and the rails 38 of guide members 36**.

Idler rolls 92 also extend between flanges 48, 50 of each of the web roll mechanisms. Idler rolls 92 may be mounted so as to be aligned with the vertical ends of opening 14, and in close proximity to the inside surface of sheet 22 at such vertical end.

The intermediate portion of web 16 then extends around the idler roll 92 in the other of web mechanisms **46*a*, 46*b*** to the web roll in that mechanism.

Web 16 may be subdivided into a plurality of viewing areas, or subdivisions, as by opaque borders 102 printed on the web. The viewing subdivisions may extend across the web in a vertical direction, such as viewing area 100*a*, shown in FIGS. 1, 7, 10, and 12. Or, the viewing areas may comprise both vertical and horizontal subdivisions of the web, as in viewing areas 100*b*, 100*c*, shown in the same Figs. Borders 102 may be omitted, if desired, as when the indicia panel 18 extends completely across opening 14.

Figure 11:
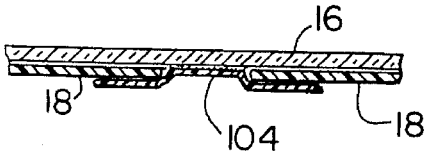
FIG. 11 is a cross-sectional view taken along the line 11—11 of FIG. 10.

An indicia panel 18 containing a product picture, pricing, product identification, or other information may be provided in each of the viewing subdivisions. To this end, and in the embodiment shown in FIGS. 10 and 11, strip of clear or translucent plastic 104 may be bonded to web 16 in opaque portions 102. In the orientation shown in FIG. 10, the strips lie along the vertical edges of the viewing subdivisions. Strips 104 lie parallel to the axes of web rolls 52. The portion of strip 104 bonded to the web is shown by dotted lines in FIG. 10 and form pockets along either side of the viewing subdivisions. Strips 104 may be secured to web 16 by any appropriate technique, such as adhesives, double sided adhesive tape, ultrasonic bonding, stapling, or the like.

To mount panel 18 on web 16, the side edges of the panels are slipped between web 16 and the strips 104 along each side of the viewing subdivision. This displays the panel in the manner shown in FIGS. 10 and 11.

Another technique for retaining panel 18 on web 16 is shown in FIGS. 7, 8, and 9. Each of strips 104 contains an angled slit 106 running across the corner of the viewing subdivision. As shown most clearly in FIG. 9, the corner portion of indicia panel 18 extends through slit 106, to hold the indicia panel in place in the viewing subdivision. Angled slits may be used with strips 104 secured to web 16 in the manner shown in FIG. 10. Or, strips 104 may be secured to web, only along the central portion of each strip, as shown in the cross-sectional view of FIG. 11.

It will be appreciated that as web 16 is traversed between web rolls 52 of web roll mechanism 46*a*, 46*b*, relative movement will occur between web 16 and indicia panels 18, due to the differing radial distances of the two thicknesses from the axis of the web rolls. Strips 104 and/or slits 106 permit this relative motion to occur, while at the same time, maintaining the proper orientation of the indicia panel with respect to the viewing subdivision.

In the embodiment of the invention shown in FIG. 2, strips 104 are mounted on the inner surface of web 16, that is, the surface opposite to that adjacent opening 14. It will be appreciated, however, that the strips may be mounted on the outer surface of web 16, if desired.

Figure 13:
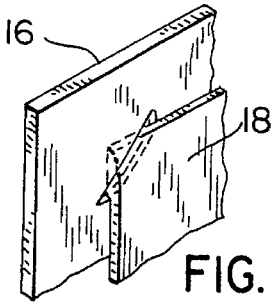
FIG. 13 is a detailed view of the portion of the web of FIG. 12 showing a manner in which indicia panels are held to the web.
Figure 12:
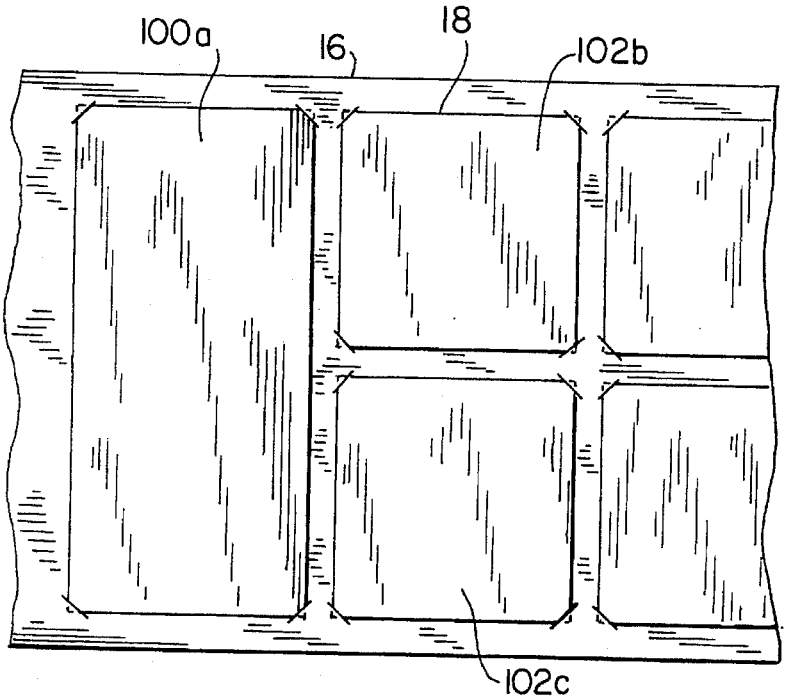
FIG. 12 is a partial view showing a further embodiment of the traversable web.

Further, it will be appreciated that in the appropriate instance, it may be possible to mount indicia panels by means of angled slits 106 in web 16 and without the use of strips 104, as shown in FIGS. 12 and 13. Indicia panels 18 may be mounted either on the inner surface or the outer surface of web 16 by this technique.

In use, sign mechanism 11 may be accessed either by pivoting the sign mechanism with respect to signage apparatus enclosure 28 or by removing sign mechanism 11 from the signage apparatus enclosure 28. Indicia panels 18 containing the information desired to be displayed are then mounted on web 16. To mount the indicia panels, the pertinent portions of web 16 are traversed to a position between the web roll mechanisms by operating hand crank 72, connected to the appropriate web roll mechanism 46*a*, 46*b*. Indicia panels 18 are affixed to web 16 by placing the side edges of the indicia panels 18 under strips 104 along each side of the viewing subdivisions in which the indicia panels are to be displayed and/or by placing corners of the indicia panels through the angled slits 106. When the portion of web 16 appearing between the web roll mechanisms has been filled with the desired indicia panels, web 16 may be traversed to a further portion of the web so that the viewing subdivisions in such other portions of the web may receive indicia panels.

When the web has received the all desired indicia panels, sign mechanism 11 is secured to signage apparatus enclosure 28.

One of hand cranks 72 is then operated to traverse the portion of web 16 containing the indicia panels 18 desired to be displayed across opening 14.

When it is desired to change the indicia panels 18 displayed in opening 14, the appropriate one of cranks 72 is further operated to move the desired portion of web 16 into position behind opening 14.

As will be appreciated, if desired, transparent sheet 22 may be omitted from opening 14 of the sign mechanism, thus rendering it possible to change indicia panels 18 mounted on the front surface of the web without tilting or removing sign mechanism 11 from signage apparatus enclosure 28.

Web 16 and indicia panels 18 may be formed of transparent or translucent material, thereby to permit sign mechanism to be backlit by lights contained in enclosure 28 to improve the visibility of the information displayed by the sign mechanism. The relative position of the lights contained in enclosure 28 and the components of sign mechanism 11, for example, the elements of web roll mechanisms 46*a*, 46*b* are arranged so that full, even, shadow-free backlighting is provided for signage apparatus 10.

We claim:

1. A sign mechanism having a web traversable along a direction of movement, said sign mechanism being suitable for use with signage apparatus and comprising:

frame means having an opening through which information displayed by the sign mechanism may be viewed, said frame member having ends spaced apart along the direction movement of said web;

a web roll mechanism mounted at each end of said frame means, each of said web roll mechanisms comprising:

a web roll rotatably mounted in said web roll mechanism and drive means for rotating said web roll;

a web extending between said web rolls and across said opening of said frame means, said web being mounted at each end to one of said web rolls for being wound on and unwound from said web rolls to move said web across said opening, said web having a plurality of viewing areas defined therein;

indicia panels containing information desired to be displayed by said sign mechanism; and means for mounting said indicia panels on said web in said viewing areas to position said indicia panels in said opening of said frame means when said web is traversed, said mounting means for said indicia panels comprising strips fastened in spaced pairs to said web such that one strip of the pair is adjacent one edge of a viewing area of the web and the other strip of the pair is adjacent an opposite edge of the viewing area, said strips extending across said web parallel to said web rolls and substantially entirely along said edges of said viewing areas, said strips having extensions extending normal to said web rolls adjacent corners of said viewing areas to form pockets extending substantially entirely along the edges of said viewing areas in which one or more indicia panels may be retained between said strips and the adjacent surface of said web for mounting the panels on said web in said viewing areas, said indicia panels being retained at a desired position with respect to said viewing area while relative movement between said indicia panel and said web is permitted as said web is wound on and unwound from said web rolls.

2. The sign mechanism according to claim 1 further including guide means extending between said web roll mechanisms adjacent the opening of said frame means for supporting the edges of said web as it moves between said web rolls.

3. The sign mechanism according to claim 1 wherein said web roll mechanism include idler rolls for said web to position said web in the opening.

4. The sign mechanism according to claim 1 wherein said web roll mechanisms include a differential braking means for said web rolls.

5. The sign mechanism according to claim 1 wherein said drive means for rotating said web roll includes a hand crank means.

6. The sign mechanism according to claim 5 wherein said hand crank means is journaled in said web roll mechanism inwardly of the ends of said frame means, said drive means further including drive transmission means for connecting said hand crank means to said web roll so that the former may drive the latter.

7. The sign mechanism according to claim 6 wherein said drive means for a web roll includes a first sprocket coupled to said web roll, shaft means journaled in said web roll mechanism adjacent said web roll and at a greater distance inwardly from the end of said frame means than said web roll, said shaft means containing said hand crank means, a second sprocket mounted on said shaft means, and a drive chain connecting said sprockets.

8. The sign mechanism according to claim 6 wherein said drive means for a web roll includes a first gear coupled to said web roll, shaft means journaled in said web roll mechanism adjacent said web roll and at a greater distance inwardly from the end of said frame means, said shaft means containing said hand crank means, and a second gear mounted on said shaft means and engageable with said first gear.

9. The sign mechanism according to claim 6 wherein said drive means includes a ratchet means so that said hand crank means can turn said web roll in one direction only.

10. The sign mechanism according to claim 1 wherein said drive means includes an electric motor for driving said web roll.

11. The sign mechanism according to claim 1 wherein said sign mechanism includes means for mounting said sign mechanism in the signage apparatus.

12. The sign mechanism according to claim 1 wherein said web is subdivided into a plurality of viewing subdivisions in which indicia panels are retained on said web by said strips.

13. The sign mechanism according to claim 1 wherein at least one of said pairs of strips has slanting slits in proximity to the corners of a viewing area, the corners of an indicia panel to be retained on the viewing area extending through said slanting slits to retain said indicia panel in position with respect to said viewing area.

14. The sign mechanism according to claim 1 wherein said mounting means and indicia panels are mounted on a surface of said web opposite from the surface that is viewed by a viewer of the signage apparatus.

15. The sign mechanism according to claim 1 wherein said mounting means and indicia panels are mounted on a surface of said web that is viewed by a viewer of the signage apparatus.

16. The sign mechanism according to claim 1 wherein said opening is covered with a transparent or translucent sheet and wherein said web is viewed through said sheet.

17. A sign mechanism having a web traversable along a direction of movement, said sign mechanism being suitable for use with signage apparatus and comprising:

frame means having an opening through which information displayed by the sign mechanism may be viewed, said frame member having ends spaced apart along the direction movement of said web;

a web roll mechanism mounted at each end of said frame means, each of said web roll mechanisms comprising:

a web roll rotatably mounted in said web roll mechanism and drive means for rotating said web roll;

a web extending between said web rolls and across said opening of said frame means, said web being mounted at each end to one of said web rolls for being wound on and unwound from said web rolls to move said web across said opening, said web having a plurality of viewing areas defined therein;

indicia panels containing information desired to be displayed by said sign mechanism; and means for mounting said indicia panels on said web in said viewing areas to position said indicia panels in said opening of said frame means when said web is traversed, said mounting means for said indicia panels comprising strips fastened in spaced pairs to said web such that one strip of the pair is adjacent one edge of a viewing area of the web and the other strip of the pair is adjacent an opposite edge of the viewing area, said strips extending across said web parallel to said web rolls and substantially entirely along said edges of said viewing areas, wherein said viewing area has corners and wherein said strips have slanting slits in proximity to the corners of said viewing area, the corners of said indicia panel to be retained on the viewing area extending through said slanting slits to retain said indicia panel at a desired position with respect to said viewing area while permitting relative movement between said indicia panels and said web is permitted as said web is wound on and unwound from said web rolls.

18. The sign mechanism according to claim 17 further including guide means extending between said web roll mechanisms adjacent the opening of said frame means for supporting the edges of said web as it moves between said web rolls.

19. The sign mechanism according to claim 17 wherein said web roll mechanism include idler rolls for said web to position said web in the opening.

20. The sign mechanism according to claim 17 wherein said web roll mechanisms include a differential braking means for said web rolls.

21. The sign mechanism according to claim 17 wherein said drive means for rotating said web roll includes a hand crank means.

22. The sign mechanism according to claim 21 wherein said hand crank means is journaled in said web roll mechanism inwardly of the ends of said frame means, said drive means further including drive transmission means for connecting said hand crank means to said web roll so that the former may drive the latter.

23. The sign mechanism according to claim 22 wherein said drive means for a web roll includes a first sprocket coupled to said web roll, shaft means journaled in said web roll mechanism adjacent said web roll and at a greater distance inwardly from the end of said frame means than said web roll, said shaft means containing said hand crank means, a second sprocket mounted on said shaft means, and a drive chain connecting said sprockets.

24. The sign mechanism according to claim 22 wherein said drive means for a web roll includes a first gear coupled to said web roll, shaft means journaled in said web roll mechanism adjacent said web roll and at a greater distance inwardly from the end of said frame means, said shaft means containing said hand crank means, and a second gear mounted on said shaft means and engageable with said first gear.

25. The sign mechanism according to claim 22 wherein said drive means includes a ratchet means so that said hand crank means can turn said web roll in one direction only.

26. The sign mechanism according to claim 17 wherein said drive means includes an electric motor for driving said web roll.

27. The sign mechanism according to claim 17 wherein said sign mechanism includes means for mounting said sign mechanism in the signage apparatus.

28. The sign mechanism according to claim 17 wherein said mounting means and indicia panels are mounted on a surface of said web opposite from the surface that is viewed by a viewer of the signage apparatus.

29. The sign mechanism according to claim 17 wherein said mounting means and indicia panels are mounted on a surface of said web that is viewed by a viewer of the signage apparatus.

30. The sign mechanism according to claim 17 wherein said opening is covered with a transparent or translucent sheet and wherein said web is viewed through said sheet.

* * * * *